US006758142B1

(12) United States Patent
Seaquist

(10) Patent No.: US 6,758,142 B1
(45) Date of Patent: Jul. 6, 2004

(54) PNEUMATIC STAGE SEPARATION SYSTEM FOR TWO STAGE LAUNCH VEHICLE

(75) Inventor: John David Seaquist, Long Beach, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/352,518

(22) Filed: Jan. 28, 2003

(51) Int. Cl.[7] ..... F42B 15/10

(52) U.S. Cl. ..... 102/377; 102/378; 102/158 R; 89/1.14

(58) Field of Search ..... 102/378, 293, 102/377; 89/1.14, 1.54; 244/158 R; 411/433–434

(56) References Cited

U.S. PATENT DOCUMENTS 3,114,962 A * 12/1963 Brown
3,185,090 A * 5/1965 Bockman, Jr. ..... 89/1.14
3,262,351 A * 7/1966 Webb ..... 89/1.14
3,352,192 A * 11/1967 Webb ..... 102/378
3,813,984 A * 6/1974 Selinder ..... 89/1.14
4,002,120 A * 1/1977 Swales et al. ..... 102/378
4,187,759 A * 2/1980 Toy et al. ..... 89/1.14
4,648,321 A * 3/1987 Lusk ..... 102/378
4,867,357 A * 9/1989 Inglis et al. ..... 102/377
4,889,030 A * 12/1989 Grosswendt et al. ..... 89/1.14
4,929,135 A * 5/1990 Delarue et al. ..... 102/378
5,115,708 A * 5/1992 Spariat et al. ..... 89/1.14
5,402,728 A * 4/1995 Garner
5,653,549 A * 8/1997 Geyer et al.
5,671,650 A * 9/1997 Aubret ..... 89/1.14

* cited by examiner

*Primary Examiner*—Michael J. Carone
*Assistant Examiner*—L. Semunegus
(74) *Attorney, Agent, or Firm*—Stetina Brunda Garred & Brucker

(57) ABSTRACT

A separating connector assembly system for a two-stage reusable launch vehicle. The system includes a plurality of separating connector assemblies each having a gas pressurizable first chamber within a first stage of the launch vehicle and a second chamber within a second stage of the launch vehicle. The system further includes a bolt and nut assembly including a bolt and a pressure-expandable nut, with the bolt projecting from the second chamber into the first chamber and engaged under atmospheric pressure with the nut which is disposed in the first chamber. Pressurized gas is made available from a single manifold in communication with each first chamber such that pressurized gas is simultaneously delivered to all first chambers for substantially simultaneously expanding all pressure-expandable nuts and releasing all respective bolts from these nuts for subsequent disconnected separation of the two stages.

20 Claims, 2 Drawing Sheets

PNEUMATIC STAGE SEPARATION SYSTEM FOR TWO STAGE LAUNCH VEHICLE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates in general to launch vehicle stage separation, and in particular to a separating connector assembly system for a two-stage reusable launch vehicle wherein cold gas pressurization expands pressure-expandable nuts initially secured to bolts bridging between the two stages to thereby produce bolt release and subsequent stage separation simultaneous with bolt capture for reuse.

While separable launch vehicles such as those deployed in space exploration have been used for a number of years, the separation event itself, whereby stage separation is made to occur, generally has involved either the use of explosive pyrotechnics or the use of mechanical engagement devices to accomplish the separation of bolts or bolt-like connectors from respective retention nuts or nut-like connectors. With respect to the former approach, hot gases have been used to influence expansion-contraction properties of connectors in causing their respective releases from each other. With respect to the latter approach, connector hardware itself is fashioned to be mechanically manipulated on command to accomplish separation.

While the above described techniques permit stage separation, such separation can be burdensome because of specialized conditions, tools, and the like that must be employed for successful operations. Consequently, a need is present for a readily usable separation system that provides effective release while capturing connector components for subsequent reuse. Accordingly, a primary object of the present invention is to provide a separating connector assembly system for a two-stage reusable launch vehicle where cold pressurized gas can be employed to pneumatically separate respective bolts from respective nuts.

Another object of the present invention is to provide a separating connector assembly system in which a single manifold delivers pressurized gas substantially simultaneously to all connectors of the system for uniformly timed releases.

Yet another object of the present invention is to provide a separating nut assembly system where components thereof are retained with separated stages for re-assembly and reuse.

These and other object of the invention will become apparent throughout the description thereof which now follows.

BRIEF SUMMARY OF THE INVENTION

The present invention is a separating connector assembly system for a reusable launch vehicle having at least first and second stages. The system includes a plurality of separating connector assemblies each having a gas pressurizable first chamber securable within the first stage of the launch vehicle and a second chamber securable within the second stage of the launch vehicle such that the first and second chambers are in alignment with each other. The system further includes a bolt and nut assembly comprising a bolt and a pressure-expandable nut, with the bolt projecting from the second chamber into the first chamber and engaged under atmospheric pressure with the nut which is disposed in the first chamber. Pressurized gas is made available from a pressurized gas-containing single manifold in communication with each first chamber such that pressurized gas is simultaneously delivered to all first chambers for substantially simultaneously expanding all pressure-expandable nuts and releasing all respective bolts from these nuts.

The invention includes methodology incorporating the above-described system for accomplishing disconnection Qf first and second stages from each other, as well as inclusion of a standard pyrotechnic force for separating the first and second stages of the launch vehicle from each other. The present invention thus provides efficient and effective stage separation of a launch vehicle while permitting re-setting and subsequent reuse of all components upon high-pressure dissipation.

BRIEF DESCRIPTION OF THE DRAWINGS

An illustrative and presently preferred embodiment of the invention is shown in the accompanying drawings in which.

DETAILED DESCRIPTION OF A PREFERRED EMBODIMENT

Figure 1:
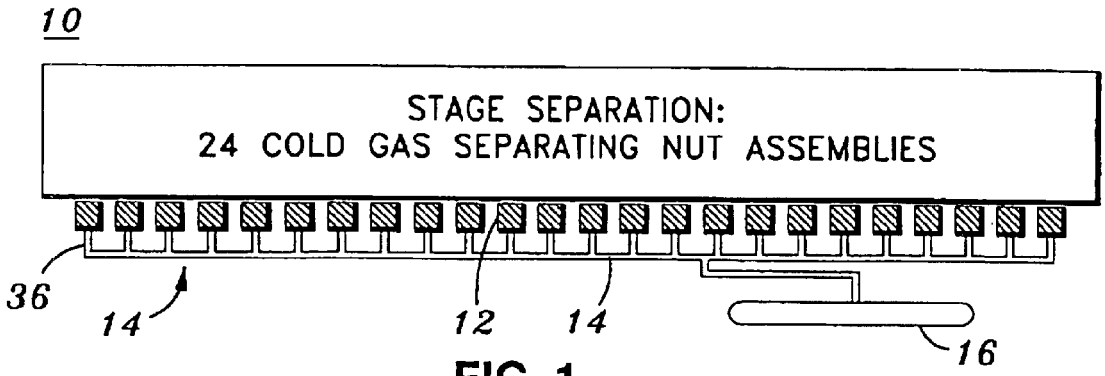
FIG. 1 is a schematic representation of a separating connector assembly system for a two-stage reusable launch vehicle.

Referring first to FIG. 1, a separating connector assembly system 10 for a two-stage reusable launch vehicle is schematically illustrated. The system 10 includes a plurality (here 24) of separating connector assemblies 12, as described below, each in communication with a single manifold 14. The manifold 14 is in communication with a conventional pressurized gas source 16 such that pressurized gas can reside within and flow through the manifold 14. A two-stage reusable launch vehicle typically is cylindrical in shape and separates into two cylindrical stages. The stages thus are joined about a circumference of the vehicle and the separating connector assemblies 12 are positioned uniformly around that circumference site.

Figure 2:
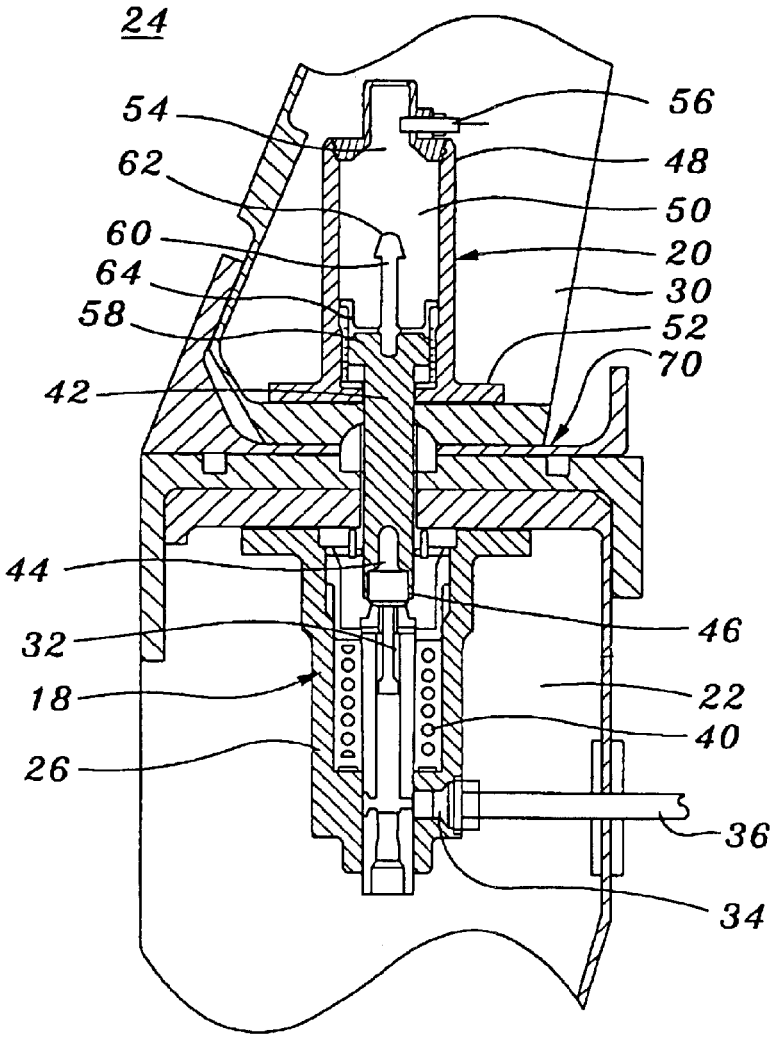
FIG. 2 is an elevation view in section of a separating connector assembly.
Figure 3:
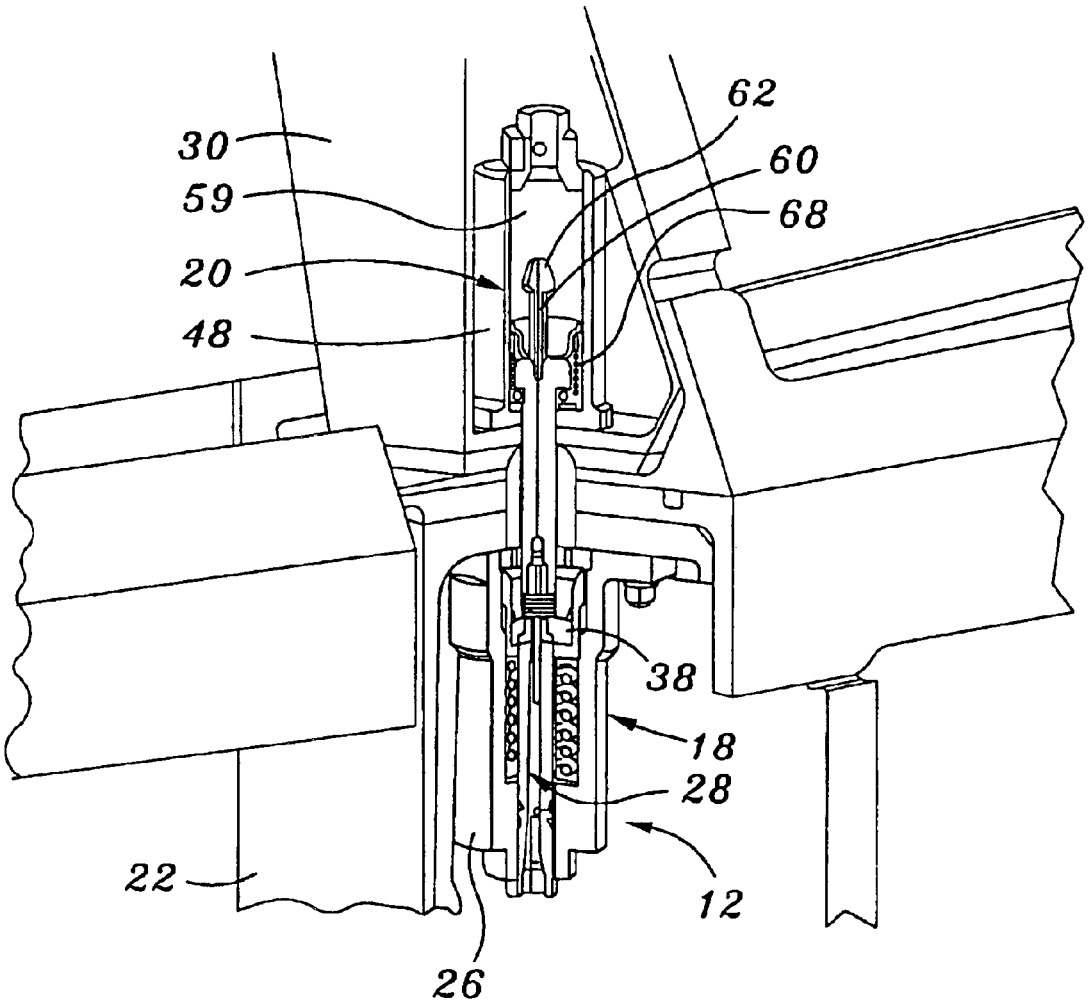
FIG. 3 is a trimetric cutaway view of the assembly of FIG. 2.

Referring now to FIGS. 2 and 3, there is depicted one exemplary separating connector assembly 12 of the separating connector assembly system 10. Each connector assembly 12 comprises a nut assembly 18 which is attached or secured within a first stage 22 of a launch vehicle 24, and a bolt retainer 20 which is attached or secured within a second stage 30 of the launch vehicle 24. As seen in FIGS. 2 and 3, the nut assembly 18 and bolt retainer 20 are attached to the first and second stages 22, 30, respectively, so as to be in alignment with each other.

The nut assembly 18 comprises a housing 26 which defines a gas pressurizable interior chamber 28. The housing 26 defines an opposed pair of laterally extending flange portions 32 which are rigidly attached to the first stage 22 of the launch vehicle 24. Formed within the side wall of the housing 26 in close proximity to the distal end thereof is an inlet port 34 which fluidly communicates with the interior chamber 28. Fluidly connected to the inlet port 34 is a delivery tube 36 which itself fluidly communicates with the interior chamber 28. The delivery tube 26 extends to and is fluidly coupled to the manifold 14, and is used to facilitate the delivery of pressurized gas into the interior chamber 28 for reasons which will be discussed in more detail below.

Disposed within the interior chamber 28 is an annular, pressure-expandable nut 38. The nut 38 is normally biased to a location within the interior chamber 28 in relative close proximity to the flange portions 32 by a coil spring 40 which extends between the nut 38 and an annular shoulder defined by the inner surface of the housing 26.

The connector assembly 12 further comprises an elongate, generally cylindrical bolt 42 having a lower end 44 which is advanced into the interior chamber 28 of the housing 26. When the connector assembly 12 is in its unactuated state (i.e., the first and second stages 22, 30 are maintained in engagement to each other), the lower portion of the bolt 42 defining the lower end 44 thereof is cooperatively engaged to the nut 38. More particularly, the lower portion of the bolt 42 is advanced into the circularly configured bore defined by the nut 38. Because the nut 38 is pressure-expandable, the rigid engagement of the nut 38 to the bolt 42 occurs when ambient pressure is sufficiently low (e.g., atmospheric pressure and lower) to prevent any expansion of the nut 38. Disposed within the lower end 44 of the bolt 42 is a recess 46 which is placed into fluid communication with the interior chamber 28 of the housing 26 via a portion of the bore of the nut 38.

The bolt retainer 20 of each connector assembly 12 comprises a generally cylindrical housing 48 which itself defines an interior chamber 50. The housing 48 defines an opposed pair of laterally extending flange portions 52 at one end thereof which are used to rigidly secure the housing 48 to the second stage 30 of the launch vehicle 24. The housing 48 also defines a reduced diameter distal portion 54. Laterally advanced into the distal portion 54 is a pin 56 which is selectively removable or detachable from the housing 48. As indicated above, the housing 48, and hence the bolt retainer 20, is preferably attached to the second stage 30 such that the interior chamber 50 is in substantial coaxial alignment with the interior chamber 28 of the housing 26 of the nut assembly 18 attached to the first stage 22.

When each connector assembly 12 is in its unactuated state, the bolt 42 extends through complementary, coaxially aligned openings disposed within the first and second stages 22, 30, with the upper portion of the bolt 42 defining the upper end 58 thereof residing within the interior chamber 50 of the housing 48. Attached to and extending axially from the upper end 58 of the bolt 42 is a striker member 60 which defines an enlarged distal end 62. As best seen in FIG. 2, the striker member 60, including its distal end 62, is coaxially aligned with the reduced diameter distal portion 54 of the housing 48. When the pressure expandable nut 38 is cooperatively engaged to the lower portion of the bolt 42 (i.e., the connector assembly 12 is in its unactuated state), the length of the bolt 42 is such that the upper portion thereof resides within the interior chamber 50 of the housing 48 at a location in relative close proximity to the flange portions 52 of the housing 48. Compressed between a retainer member 64 attached to the upper end 58 of the bolt 42 and a portion of the inner surface of the housing 48 is a coil spring 68.

The actuation of the connector assembly 12 is facilitated by introducing high pressure gas into the interior chamber 28 of the housing 26 of the nut assembly 18. Such gas is introduced into the interior chamber 28 via the delivery tube 36, and flows through the interior chamber 28 into the bore of the pressure expandable nut 38, and thus into the recess 46 disposed within the lower end 44 of the bolt 42. A preferred pressurizing gas is nitrogen which is preferably pressurized in the manifold 14 at approximately 400 to 600 pounds per square inch for like pressurization within the interior chamber 28 when release of the bolt 42 and hence actuation of the connector assembly 12 is desired. More particularly, the gas acts against the nut 38 in a manner facilitating the radial expansion thereof. Such radial expansion of the nut 38 results in the disengagement thereof from the lower portion of the bolt 42. Upon such disengagement, the force of the pressurized gas acting against the bolt 42 due to the flow of such gas into the recess 46 results in the rapid thrusting of the bolt 42 into the interior chamber 50 of the housing 48 of the bolt retainer 20. Such movement of the bolt 42 results in the advancement of the distal end 62 of the striker member 60 into the distal portion 54 of the housing 48. Such advancement results in the cooperative engagement of the pin 56 to the striker member 60 in a manner effectively capturing and retaining the bolt 42 within the housing 48.

As the bolt 42 is being advanced within the interior chamber 50 in the above-described manner, it is important that the first and second stages 22, 30 of the launch vehicle 24, which are being disengaged from each other by the actuation of the connector assemblies 12, be constrained or prevented from radial displacement at the location of each bolt 42. In this respect, any such radial displacement of one of the first and second stages 22, 30 relative to the other could effectively place the bolts 42 of the connector assemblies 12 into a shear condition, thus compromising the ability of the first and second stages 22, 30 to properly separate from each other. To prevent such radial displacement, a shear member 70 is preferably included with each connector assembly 12 of the separating assembly system 10. As seen in FIGS. 2 and 3, the shear member 70 of each connector assembly 12 is disposed between the first and second stages 22, 30 at a location whereat the corresponding bolt 42 is axially advanceable therethrough.

The connection and selective separation of the first and second stages 22, 30 of the two-stage launch vehicle 24 is accomplished by first connecting corresponding bolts 42 and nuts 38 of the connector assemblies 12 to each other at atmospheric or other ambient pressure wherein the nuts 38 are not expanded. Thereafter, when stage separation of the vehicle 24 is desired, a conventional electrical signal command is directed to activate gas pressurization within the manifold 14 which substantially immediately results in like pressurization of the interior chambers 28 of the housings 26 of the nut assemblies 18 of all the connector assemblies 12. Such pressurization results in the substantially simultaneous (i.e., all preferably within 2.5 milliseconds) expansion of all the nuts 38 and the resultant release of all the bolts 42 to thereby disconnect the first and second stages 22, 30 from each other. Typically coordinated with such pressurization and disconnection is the separate simultaneous standard pyrotechnic gas delivery to the site of stage interface to thereby cause an immediate launch of the second stage 30 of the vehicle 24 from the first stage 22. The reuse of each connector assembly 12 is initiated by removing the pin 56 from within each corresponding housing 48 which releases the bolt 42 in a manner allowing the same, and in particular the lower portion thereof, to be advanced back into the interior chamber 28 and re-engaged to a corresponding nut 38.

As is thus apparent, the present system 10 permits the bolts 42 and nuts 38 to be disconnected using only pressurized, non-heated gas delivered from a single source simultaneously to all sites to thereby increase efficiency and dependability. While an illustrative and presently preferred embodiment of the invention has been described in detail herein, it is to be understood that the inventive concepts may be otherwise variously embodied and employed, and that the appended claims are intended to be construed to include such variations except insofar as limited by the prior art.

What is claimed is:

1. A separating connector assembly system for a reusable launch vehicle having at least first and second stages, the system comprising:

a) a plurality of separating connector assemblies each comprising:

i) a gas pressurizable first chamber securable within the first stage of the launch vehicle;

ii) a second chamber with a chamber size securable within the second stage of the launch vehicle and in alignment with the first chamber, the second chamber defining a distal portion having a distal size substantially smaller than the chamber size; and iii) a bolt and nut assembly comprising a bolt with a striker member and a pressure-expandable nut, the striker member having a distal striker end with an end size substantially conforming to the distal size, wherein the bolt projects from the second chamber into the first chamber and is engageable under atmospheric pressure with the nut disposed in the first chamber; and b) a pressurized gas source comprising a pressurized gas-containing single maniford in communication with each first chamber for delivering pressurized gas to all first chambers for expanding the pressure-expandable nuts and releasing the bolts from said- nuts to allow the distal striker ends to advance within the respective distal portions.

2. The separating connector assembly system as claimed in claim 1 wherein the gas within the manifold is pressurizable to a pressure of about 400–600 pounds per square inch.

3. The separating connector assembly system as claimed in claim 1 wherein the second chamber is configured to retain the bolt therewithin after said bolt is released from the nut.

4. The separating connector assembly system as claimed in claim 3 wherein:

the striker member extending form one end of the bolt; and a lock pin is removably inserted into the distal portion of the second chamber; and the release of the nut from the bolt facilitating the advancement of the striker member into the distal portion of the second chamber and engagement of the lock pin to the striker member in a manner retaining the bolt within the second chamber.

5. The separating connector assembly system as claimed in claim 1 further comprising:

a plurality of shear members disposed between the first and second stages in locations whereat the bolts of the separating connector assemblies are advancable through respective ones of the shear members; and the shear members being operative to prevent the radial movement of the first and second stages relative to each other.

6. A separating connector assembly for a reusable launch vehicle having at least first and second stages, the assembly comprising:

a) a gas pressurizable first chamber securable within the first stage of the launch vehicle;

b) a second chamber with a chamber size securable within the second stage of the launch vehicle and in alignment with the first chamber, the second chamber defining a distal portion having a distal size substantially smaller than the chamber size; and c) a bolt and nut assembly comprising a bolt with a striker member and a pressure expandable nut, the striker member having a distal striker end with an end size substantially conforming to the distal size, wherein the bolt projects from the second chamber into the first chamber and is engageable under atmospheric pressure with the nut disposed in the first chamber, the bolt being releasable from the nut to allow the distal striker end to advance within the distal portion.

7. A method of connecting and selectively separating first and second stages of a launch vehicle from each other, the method comprising;

a) securing the first and second stages to each other with a plurality of separating connector assemblies each comprising;

i) a gas pressurized first chamber secured within the first stage of the launch vehicle;

ii) a second chamber secured within the second stage of the launch vehicle and in alignment with the first chamber, the second chamber defining a distal portion having a distal size substantially smaller than the chamber size; and iii) a bolt and nut assembly comprising a bolt with a striker member and a pressure-expandable nut, the striker member having a distal striker end with an end size substantially conforming to the distal size, wherein the bolt projects from the second chamber into the first chamber and is engaged under atmospheric pressure with the nut disposed in the first chamber; and b) pressurizing all the first chambers substantially simultaneously to a pressure adequate for expanding the respective pressure-expandable nuts and releasing the respective bolts from said nuts to allow the distal striker ends to advance within the respective distal portions, whereby the first and second stages of the launch vehicle are disconnected.

8. The method as claimed in claim 7 wherein the first chambers are pressurized to a pressure of about 400–600 pounds per square inch.

9. The method as claimed in claim 7 wherein a single manifold is connected to every first chamber and thereafter pressurized for substantially simultaneously pressurizing said first chambers.

10. The method as claimed in claim 7 additionally comprising the step of:

(c) applying a pyrotechnic force for separating the first and second stages of the launch vehicle from each other.

11. The separating connector assembly system as claimed in claim 1 wherein the chamber sizes are diameters of the second chambers.

12. The separating connector assembly system as claimed in claim 1 wherein the distal sizes are diameters of the distal portions.

13. The separating connector assembly system as claimed in claim 1 wherein the end sizes are diameters of the distal striker ends.

14. The separating connector assembly as claimed in claim 6 further comprising:

a shear member disposed between the first and second stages in a location whereat the bolt is advancable through the shear member; and the shear member being operative to prevent the radial movement of the first and second stages relative to each other.

15. The separating connector assembly as claimed in claim 6 wherein the chamber size is a diameter of the second chamber.

16. The separating connector assembly as claimed in claim 6 wherein the distal size is a diameter of the distal portion.

17. The separating connector assembly as claimed in claim 6 wherein the end size is a diameter of the distal striker end.

18. The method as claimed in claim 7 wherein the chamber sizes are diameters of the second chambers.

19. The method as claimed in claim 7 wherein the distal sizes are diameters of the distal portions.

20. The method as claimed in claim 7 wherein the end sizes are diameters of the distal striker ends.

* * * * *